US005174312A

United States Patent [19]

Adams

[11] Patent Number: 5,174,312

[45] Date of Patent: Dec. 29, 1992

[54] HEADWEAR APPARATUS

[76] Inventor: Joey M. Adams, P.O. Box 607, Harrisonville, Mo. 64701

[21] Appl. No.: 790,432

[22] Filed: Nov. 12, 1991

[51] Int. Cl.[5] ..... A45D 8/36

[52] U.S. Cl. ..... 132/273; 132/130; 132/132; 132/138; 2/171

[58] Field of Search ..... 132/273, 275, 276, 277, 132/278, 279, 129, 130, 132, 133, 138; 2/DIG. 11, 171, 171.1, 173

[56] References Cited

U.S. PATENT DOCUMENTS

| | | | |
|---|---|---|---|
| D. 42,929 | 4/1910 | Austin | 132/273 |
| 904,411 | 11/1908 | Damon | 132/133 |
| 1,437,440 | 12/1922 | Pentecost | 132/273 |
| 1,596,737 | 8/1926 | Johnson | 132/133 |
| 1,721,837 | 7/1929 | Schurger | 132/133 |
| 2,902,042 | 9/1959 | Halber | 132/279 |
| 3,184,758 | 5/1965 | Hirsch | 2/DIG. 11 |
| 3,467,111 | 9/1969 | Benson | 132/273 |
| 3,860,014 | 1/1975 | Clifton | 132/278 |
| 4,742,581 | 5/1988 | Rosenthal | 2/171 |
| 4,998,544 | 3/1991 | Obergfell | 132/212 |

*Primary Examiner*—Gene Mancene
*Assistant Examiner*—Frank A. LaViola
*Attorney, Agent, or Firm*—Hovey, Williams, Timmons & Collins

[57] ABSTRACT

A headwear apparatus includes a butterfly chip comb assembly and an elongated, moisture absorbent headband. The comb assembly includes a pair of hingedly coupled combs with inwardly facing tines shiftable between open and closed positions and having a retainer for holding the combs in the closed position. The headband presents respective end regions having a plurality of transverse, tine receiving slots defined therein which allow adjustable length coupling of the end regions with the respective combs. In use, with the combs in the open position, the headband is placed about the user's head with a portion of the user's hair gathered between the combs; the combs are then shifted to the closed position which snugs the headband to hold it in place about the user's head and holds the user's hair in the gathered configuration.

16 Claims, 1 Drawing Sheet

HEADWEAR APPARATUS

BACKGROUND OF THE INVENTION

1. Field of the Invention

The present invention is concerned with the field of headwear. More particularly, the preferred embodiment is concerned with a headwear apparatus including a hingedly coupled, dual comb assembly for holding a user's hair in a gathered configuration and an elongated, moisture absorbent headband for substantially encircling the user's head.

2. Description of the Prior Art

As those who engage in physical exercise appreciate, headbands are commonly worn to prevent perspiration from entering the eyes and also as a matter of style. Additionally, it is often preferred by those with long hair to gather the hair at the back of the head during exercise to prevent the hair from falling into one's face and for general comfort. It may happen, however, that if the hair is gathered into a ponytail, the shank or base of the ponytail is positioned at the most desirable level for the headband. Because of this, that portion of the headband adjacent to the ponytail must be placed either under or over the hair shank. When placed under the shank, the forward portion of the headband has a tendency to ride downwardly into the eyes, and if placed over the shank, has a tendency to come off.

In an attempt to solve these prior art problems, U.S. Pat. No. 4,998,544, incorporated herein by reference, discloses a combination headband and ponytail holder in which the headband has an aperture surrounded by a loop of elastic material through which the user's hair can be placed to form a ponytail. While '544 device prevents the headband from slipping, it necessarily requires that the hair be configured in the form of a ponytail and does not allow the user to gather the hair into the configuration of a "fall," "bustle," or fashionable configuration other than a ponytail. Additionally, this prior art device does not allow the user to shift the headband upwardly or downwardly to a desired position. That is to say, some users may prefer to locate the headband at a level above or below the base of the ponytail which is not possible with the '544 headband.

Additionally, some prior art headbands are configured as an elastic loop. Such loop-type headbands are normally sold in one size which, for some users, may be too tight while too loose for others, especially if the band stretches after a number of usages.

SUMMARY OF THE INVENTION

The headband apparatus of the present invention solves the prior art problems discussed above and provides a distinct advance in the state of the art. More particularly, the apparatus hereof allows a user to gather and hold the user's hair in the desired configuration, to position the headband at a desired location on the user's head, and to adjust the headband to a desired snug fit.

Broadly speaking, the preferred headwear apparatus includes a comb assembly and an elongated headband coupled therewith. The comb assembly includes a pair of combs shiftable toward and away from one another between respective closed and open positions with the respective tines of the combs facing inwardly, and further includes retainer means for holding the combs in the closed position. The headband presents respective end regions having transverse, coupling slots defined therein for receiving a set of tines therethrough in order to couple the respective end regions of the headband to the combs.

In preferred forms, each end region of the headband includes a plurality of the coupling slots spaced apart for allowing selective adjustment of the effective length of the headband depending upon which slots are selected for receiving a set of tines therethrough. Additionally, zig-zag stitching spans each slot for yieldable reinforcement thereof while allowing tines to be received between the various stitches. The preferred configuration also allows a selected slot to be shifted for registration with a different set of tines in order to change the coupling location of the headband relative to the combs, which thereby allows the user to selectively alter the level of the headband on the user's head.

DETAILED DESCRIPTION OF THE PREFERRED EMBODIMENT

Figure 1:
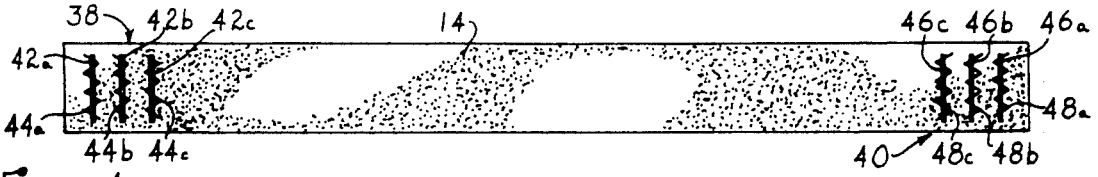
FIG. 1 is a plan view of the preferred headband making up a part of the invention hereof.
Figure 2:
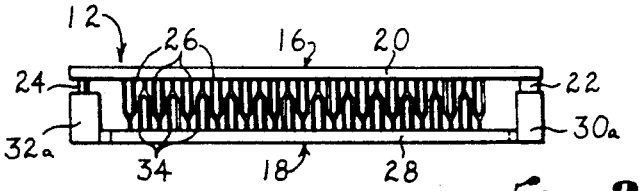
FIG. 2 is a plan view of the preferred comb assembly making up a part of the invention hereof.
Figure 3:
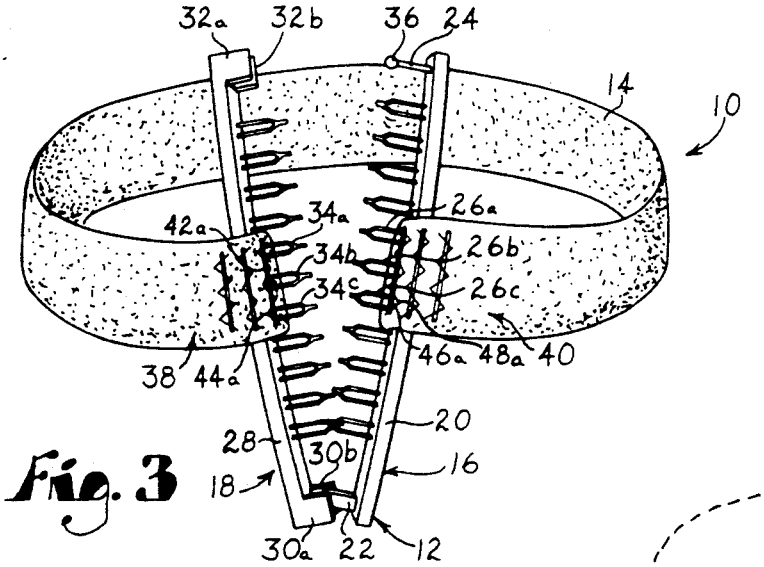
FIG. 3 is a perspective view of the preferred headband apparatus showing the combs of the comb assembly in an open position.
Figure 4:
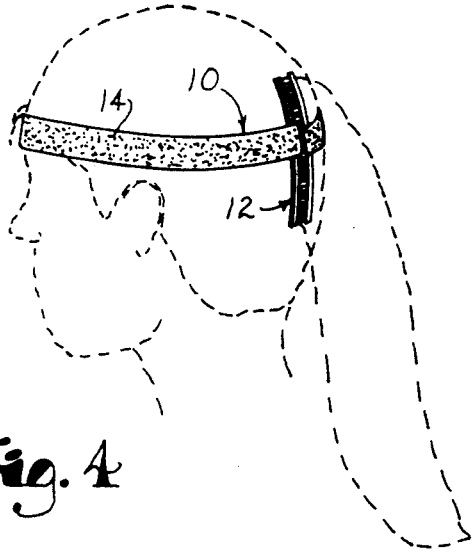
FIG. 4 is a perspective view of the preferred headband apparatus in position on the head of the user shown in dashed lines with the combs retained in the closed position.

Preferred headwear apparatus 10 is illustrated in FIGS. 3 and 4 and broadly includes comb assembly 12 (FIG. 2) and headband 14 (FIG. 1.)

Comb assembly 12 is preferably a GOODY brand "clincher comb" and includes combs 16 and 18 with each presenting a generally arcuate configuration designed to conform to the shape of the person's head. Comb 16 integrally includes arcuate base 20 with hinge element 22 extending outwardly from one end thereof, retaining element 24 extending outwardly from the opposed end base 20, and spaced tines 26 extending outwardly from base 20 and between elements 22 and 24, as illustrated. Comb 18 integrally includes arcuate base 28, outwardly extending, spaced, hinge receivers 30*a* and 30*b* adjacent end of base 28, outwardly extending, spaced retainer receivers 32*a* and 32*b* adjacent the opposed end of base 28, and spaced tines 34 extending outwardly from base 28 and between receivers 30*a,b* and 32*a,b*.

As best shown in FIG. 3, hinge element 22 is received between hinge receivers 30*a,b* with an integral projection (not shown) received within a corresponding indentation (not shown) to form a conventional detent for hingedly retaining element 22 between receivers 30*a,b*. This allows combs 16 and 18 to hingedly shift toward and away from one another between closed (FIG. 4) and open (FIG. 3) position. Tines 26 and 34 face inwardly, that is, toward one another, and are arranged in respective off-set or staggered configurations so that the tines of one comb are in registration with the spaces between the tines of the other comb. Retaining element 24 includes retaining ball 36 which is receivable between retainer receivers 32*a,b* into a corresponding indentation (not shown) to form a detent for selectively holding combs 16,18 in the closed position.

Elongated headband 14 is preferably composed of a moisture absorbent material such as cotton having terry knit loops otherwise known as terry cloth, and presents a length sufficient to substantially encircle a user's head. Headband 14 presents end regions 38 and 40 as best viewed in FIG. 1. As those skilled in the art will appreciate, headband 14 can include elastic for expansion about the user's head.

In the preferred embodiment, region 38 includes structure defining a plurality of transverse, tine-receiving slots 42*a*, 42*b* and 42*c* with zig-zag stitches 44*a*, 44*b* and 44*c* extending respectively across the gap of each slot. Similarly, region 40 includes transverse, tine-receiving slots 46*a*, 46*b* and 46*c* with zig-zag stitches 48*a,b,c* extending respectively across the gap of each slot. Stitches 44*a,b,c* and 48*a,b,c* are preferably composed of nylon thread, are configured to receive tines 26 and 34 respectively therebetween, and aid in preserving the shape of slots 42*a,b,c* and 46*a,b,c*.

FIG.3 illustrates apparatus 10 with combs 16, 18 in the open position with a set of tines 34*a,b*, and 34*c* received through slot 42*a* whereby end region 38 is coupled with comb 18. Similarly, a set of tines 26*a*, 26*b*, and 26*c* are received in slot 46*a* thereby coupling end region 40 with comb 16. As received within a given slot, the tines are received between zig-zag stitches which span the slot.

In use, headband apparatus 10 can be placed on a user's head in two alternative modes. In the first mode, with combs 16, 18 in the open position and with tines 26*a,b,c* and 34*a,b,c* facing upwardly, the user slips headband 14 over and around the head with comb assembly 12 located at the back of the head and then arranges the hair over the tines of combs 16,18. The hair is then gathered into the desired configuration and combs 16,18 shifted to the closed position by forcing retaining ball 36 between receivers 32*a,b*. This holds the hair in the gathered configuration and pulls headband 14 snugly about the user's head as illustrated in FIG. 4.

In the second mode of use, headband 14 is placed over and around the user's head with open combs 16, 18 above the hair to be gathered so that tines 26*a,b,c* and 34*a,b,c* face generally downwardly. The hair is then gathered into the desired configuration and combs 16,18 shifted to the closed position to hold the hair in place. As can be appreciated, this second mode of use may be particularly convenient for some users in that the user does not have to arrange the hair above the combs 16,18 before shifting into the closed position.

The provision of a plurality of slots 42*a,b,c* and 46*a,b,c* presents a particular advantage of the present invention in that this aspect allow the user to adjust the effective length of headband 14. That is to say, the user can select those slots for coupling which provide the desired level of snug fit.

Another advantageous feature of the present invention is the ability to adjust the height of headband 14 by selecting a desired set of tines for reception in the selected slot. For example, tine sets 34*a,b,c* and 26*a,b,c* present the level of headband 14 somewhat in the middle of the user's forehead as illustrated in FIG.4. As desired by the user, however, a different set of tines can be selected higher or lower to adjust the level of headband 14 to that desired position.

As those skilled in the art will appreciate, the present invention encompasses many variations in the preferred embodiment described herein. For example, the comb assembly could include only one of the shiftable members as a comb. In addition, the shiftable members could be separate which become coupled when shifted together and retained in the closed position. As a final example, headband 14 could be configured to present a circular shape in transverse cross section.

Having thus described the preferred embodiment of the present invention the following is claimed as new and desired to be secured by Letters Patent:

1. A headwear apparatus comprising:

a comb assembly having a pair of members shiftable toward and away from one another between respective closed and open positions with at least one of said members being configured as a comb and with the respective tines thereof facing inwardly in said closed position, and including retaining means for selectively retaining said members in said closed position; and an elongated headband having respective ends separate from and unconnected to one another, said headband being configured long enough for substantially encircling a user's head, said ends presenting respective, adjacent end regions, there being coupling means for coupling said end regions respectively with said members for shifting therewith so that upon shifting to said open position said headband may be placed about a user's head with a portion of the user's hair gathered between said members, and so that upon shifting to said closed position said headband is held in place about the user's head and the portion of the user's hair is held in a gathered configuration between said members.

2. The apparatus as set forth in claim 1, said assembly including hinge means hingedly coupling said members adjacent respective ends thereof.

3. The apparatus as set forth in claim 2, said retaining means including ball and detent structures respectively coupled with said members adjacent the ends thereof opposed to said hinge means.

4. The apparatus as set forth in claim 1, said headband being formed of moisture absorbent material.

5. The apparatus as set forth in claim 4, said material including terry cloth.

6. The apparatus as set forth in claim 1, both of said members being configured as combs with respective tines, said coupling means including slot structure defining at least one transverse slot in at least one of said end regions and configured for receiving a set of a plurality of tines of a respective comb therethrough.

7. The apparatus as set forth in claim 6, said coupling further including stitches spanning said slot for maintaining the stability thereof.

8. The apparatus as set forth in claim 7, said stitches being configured in a zig-zag pattern for receiving a set of tines therebetween.

9. The apparatus as set forth in claim 6, further including a plurality of said slots for allowing length adjustability of said headband relative to said assembly.

10. The apparatus as set forth in claim 6, said slot being configured for receiving different sets of tines therethrough for changing the coupling location of said headband relative to said combs for correspondingly changing the level of said headband on a person's head.

11. A headwear apparatus comprising:

a comb assembly having a pair of combs shiftable toward and away from one another between respective closed and open positions, said combs being configured with the respective tines thereof facing inwardly in said closed position, and including retaining means for selectively retaining said member in said closed position; and an elongated headband having respective end regions and configured long enough for substantially encircling a user's head, there being coupling means for coupling said end regions respectively with said members for shifting therewith so that upon shifting to said open position said headband may be placed about a user's head with a portion of the user's hair gathered between said combs, and so that upon shifting to said closed position said headband is held in place about the user's head and the portion of the user's hair is held in a gathered configuration between said combs, said coupling means including a plurality of spaced, transverse slots defined in at least one of said end regions for receiving a set of tines therethrough for coupling said end regions with the corresponding comb for allowing length adjustability of said headband relative to said assembly, said slots being configured for selectively receiving different sets of said tines therethrough for changing the location of said end region relative to the corresponding comb for correspondingly changing the level of said headband on a person's head.

12. A headwear apparatus comprising:

a comb assembly having a pair of members shiftable toward and away from one another between respective closed and open positions with at least one of said members being configured as a comb and with the respective tines thereof facing inwardly in said closed position, and including retaining means for selectively retaining said members in said closed position; and an elongated headband having respective end regions and configured long enough for substantially encircling a user's head, there being coupling means for coupling said end regions respectively with said members for shifting therewith so that upon shifting to said open position said headband may be placed about a user's head with a portion of the user's hair gathered between said members, and so that upon shifting to said closed position said headband is held in place about the user's head and the portion of the user's hair is held in a gathered configuration between said members, both of said members being configured as combs with respective tines, said coupling means including slot structure defining at least one transverse slot in at least one of said end regions and configured for receiving a set of a plurality of tines of a respective comb therethrough.

13. The apparatus as set forth in claim 12, said coupling means further including stitches spanning said slot for maintaining the stability thereof.

14. The apparatus as set forth in claim 13, said stitches being configured in a zig-zag pattern for receiving a set of tines therebetween.

15. The apparatus as set forth in claim 12, further comprising a plurality of said slots for allowing length adjustability of said headband relative to said assembly.

16. The apparatus as set forth in claim 12, said slot being configured for receiving different sets of tines therethrough for changing the coupling location of said headband relative to said combs for correspondingly changing the level of said headband on a person's head.

* * * * *